United States Patent [19]

Danforth

[11] 4,365,761

[45] Dec. 28, 1982

[54] APPARATUS AND METHOD FOR DEFIBERING UNCONVENTIONAL MATERIAL

[75] Inventor: Donald W. Danforth, Andover, Mass.

[73] Assignee: Bolton - Emerson, Inc., Lawrence, Mass.

[21] Appl. No.: 127,873

[22] Filed: Mar. 6, 1980

[51] Int. Cl.[3] ..... B02C 23/36

[52] U.S. Cl. ..... 241/21; 241/28; 241/46.11; 241/261.1

[58] Field of Search ..... 241/21, 28, 261.2, 242, 241/261.1, 46.11, 46.17, 46.08

[56] References Cited

U.S. PATENT DOCUMENTS

| | | | |
|---|---|---|---|
| 2,596,586 | 5/1952 | Morden | 241/261.2 |
| 3,428,261 | 2/1969 | Moulton | 241/21 |
| 3,946,951 | 3/1976 | Danforth | 241/21 |

*Primary Examiner*—Mark Rosenbaum

*Attorney, Agent, or Firm*—Pearson & Pearson

[57] ABSTRACT

A vortical circulation type pulper has a bladed and channelled rotor and an annular bladed and channeled stator mounted in a side, or bottom, wall, the rotor and annular stator forming a truncated conical attrition interface with the small end receiving stock for passage through the interface to the large end and thence for discharge or recirculation. Rotor/stator clearance at rest, is about 15/1000 of an inch. The stator is provided with an annular, pattern of alternate, triangular acquisition valleys and bladed and channeled peaks, each peak having an acquisition edge in the path of the stock reduction, edges of the rotor vanes so that the stock is reduced by the scissors-like contact of stock reduction edges of the vanes with the acquisition edges of the stator peaks in a stock reduction interface until sufficiently defibered to enter the truncated conical, bladed and channeled rotor/stator attrition interface for further treatment and recirculation or discharge.

16 Claims, 13 Drawing Figures

Fig. 1.
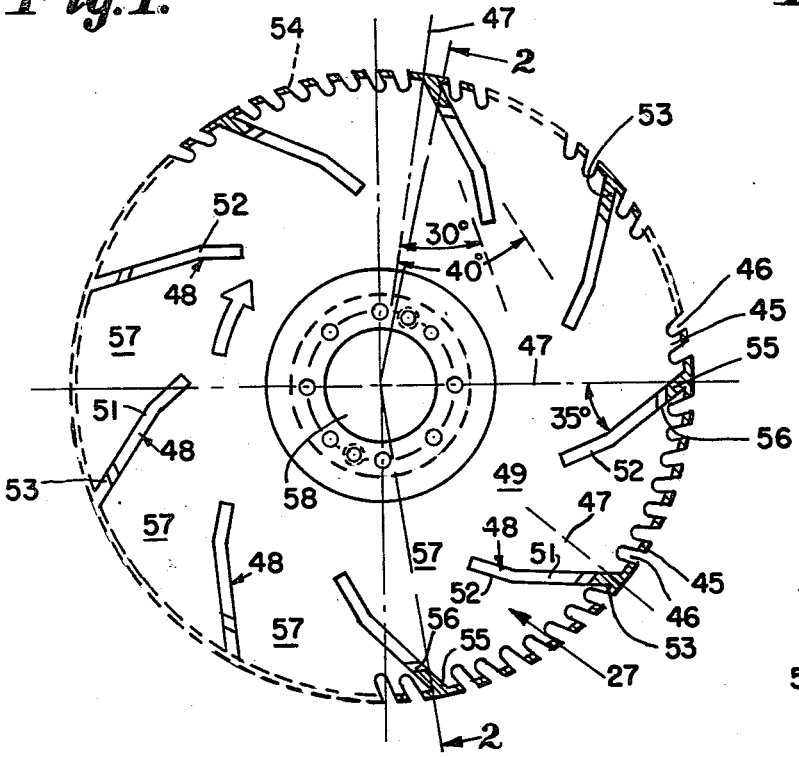
Fig. 2.
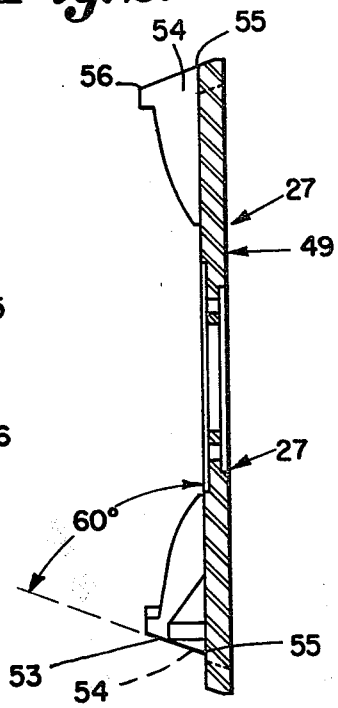
Fig. 3.
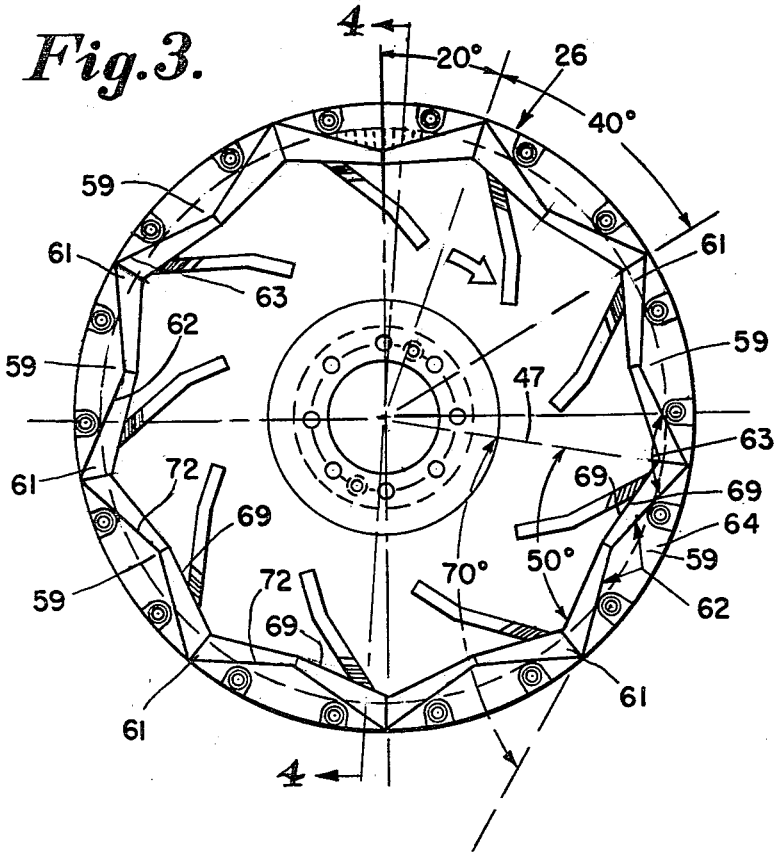
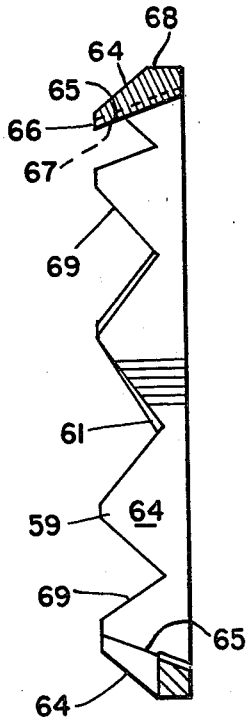
Fig. 4.

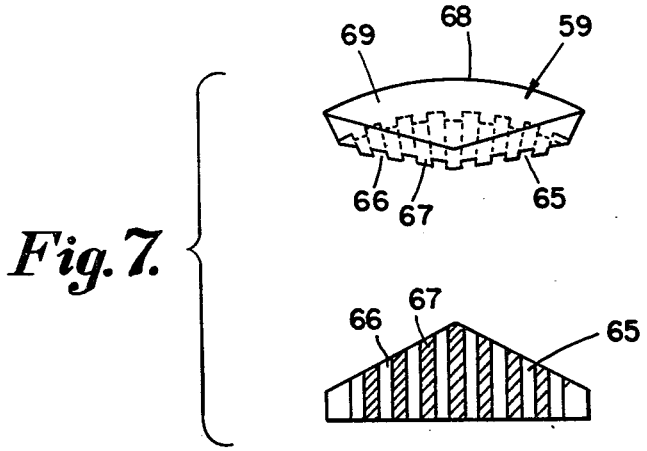
Fig. 7.
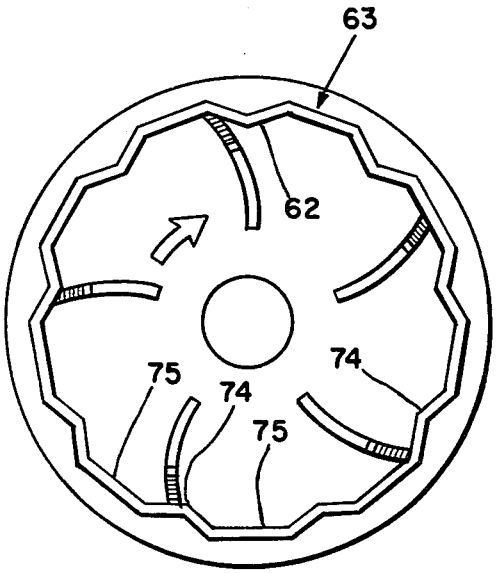
Fig. 8.
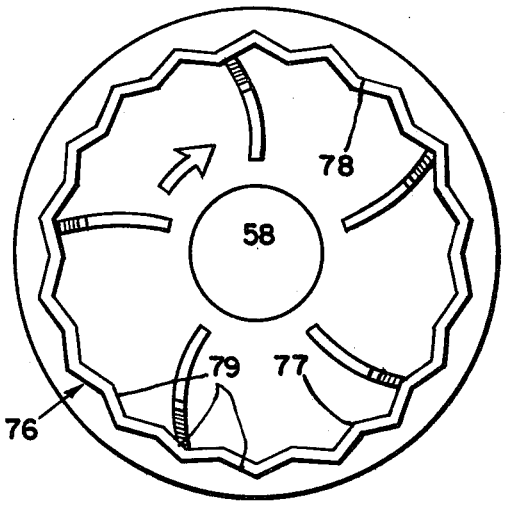
Fig. 9.
Fig. 10.
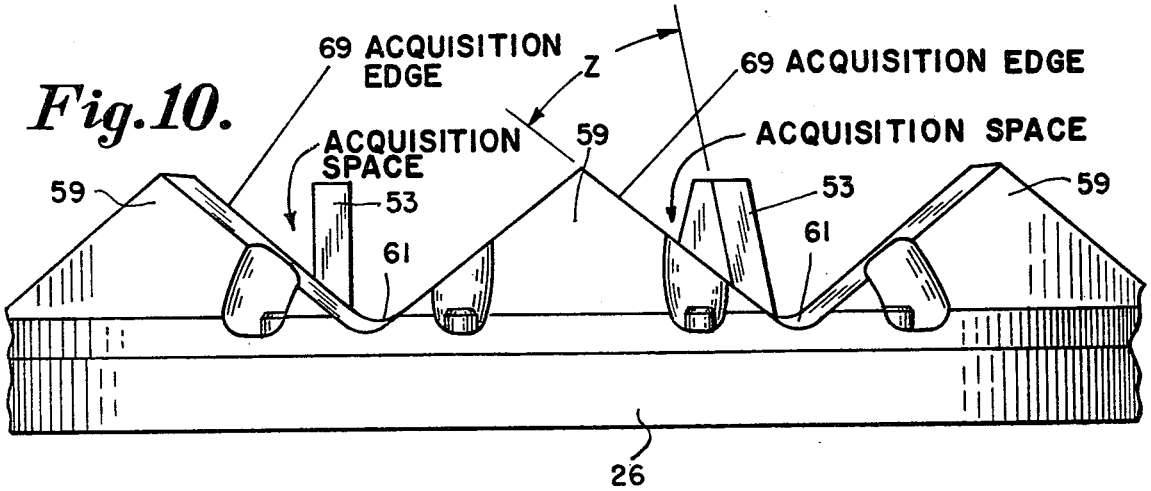

APPARATUS AND METHOD FOR DEFIBERING UNCONVENTIONAL MATERIAL

BACKGROUND OF THE INVENTION

It has heretofore been proposed in my U.S. Pat. No. 3,946,951 of Mar. 30, 1976, to process difficult to defiber stock in a vortical circulation pulper by reducing the clearance of the rotor/stator blades at the truncated conical attrition interface to zero and increasing the horsepower exerted on the zero clearance rotor at least fifty percent to achieve enough thrust and grinding action to refine the fibers.

The method operates successfully but subjects the rotor and stator to wear at a rapid rate. The rotor and stator can be made of wear resistant materials at increased cost, but economic factors make it desirable to find another solution to the problem.

SUMMARY OF THE INVENTION

In this invention, difficult to defiber stock of the hemp, flax, rag, leather, synthetic fiber, wet strength paper, sheet stock comprised of fibrous elements bound together by various adhesives, or other types of stock are enabled to be processed in a vortical circulation pulper with a predetermined blade clearance of about 15/1000 of an inch so that the wear and tear of zero clearance is avoided.

With the rotor/stator clearance of about 15/1000 of an inch, it is not necessary to increase horse power by fifty percent as disclosed in my said patent. For example, with water at 60°–70° F., in this invention, power demand is on the order of 250 HP (36" diameter, 430 RPM). Upon introduction of stock, power demand increases to 300–310 HP. Within minutes, as particle size is reduced, power is down to 280 HP and becomes progressively less as temperature rises and stock becomes finely divided. The increase in power upon introduction of the stock results simply from increased resistance, i.e.: rotor/stator clearance remains unchanged.

The above results are achieved by forming the stator in an annular pattern of generally triangular segments, the segments forming alternate peaks and valleys and either being juxtaposed, or integral as a one piece ring, in a saw tooth or serrated, design. The triangular segments may be equally spaced apart with a dwell space between adjacent segments if agitation is not of prime importance.

Each segment is preferably isosceles triangular in plan and projects inwardly from the periphery of the stator toward the center of the rotor, the apex edges of the segments outlining an interrupted ring which forms the stock inlet opening of the truncated conical interface of the rotor and stator blades.

Each peak of each segment has a forward, or "acquisition, edge" separated by an "acquisition space", or "valley" from the rearward edge of the adjacent segment and forming a predetermined angle of intersection with the outer, stock reduction, edges of the vortical circulation vanes on the rotor which produces a "scissors effect".

The interior angle at the apex, or peak of each generally triangular segment is preferably obtuse, as is the exterior angle of the acquisition space or valley between the peaks of adjacent segments and there may be as many segments as desired, depending on the agitation, circulation, and degree of breakdown of the material required by the stock charged into the pulper container.

Clearance at the truncated conical interface normally ranges from 0.010" to 0.015".

BRIEF DESCRIPTION OF THE DRAWING

FIG. 1 is a front elevation of the rotor of the invention;

FIG. 2 is a side elevation, in section on line 2—2 of FIG. 1;

FIG. 3 is a front elevation of the stator of the invention;

FIG. 4 is a side elevation in section on line 4—4 of FIG. 3;

FIG. 7 is a diagrammatic, exploded view of one of the segments of the stator.

FIGS. 8 and 9 are views similar to FIG. 6 showing other embodiments of the stator;

FIG. 10 is an enlarged, fragmentary side elevation showing the acquisition and reduction capability of the apparatus on difficult to defiber stock;

DESCRIPTION OF THE PREFERRED EMBODIMENT

Figure 5:
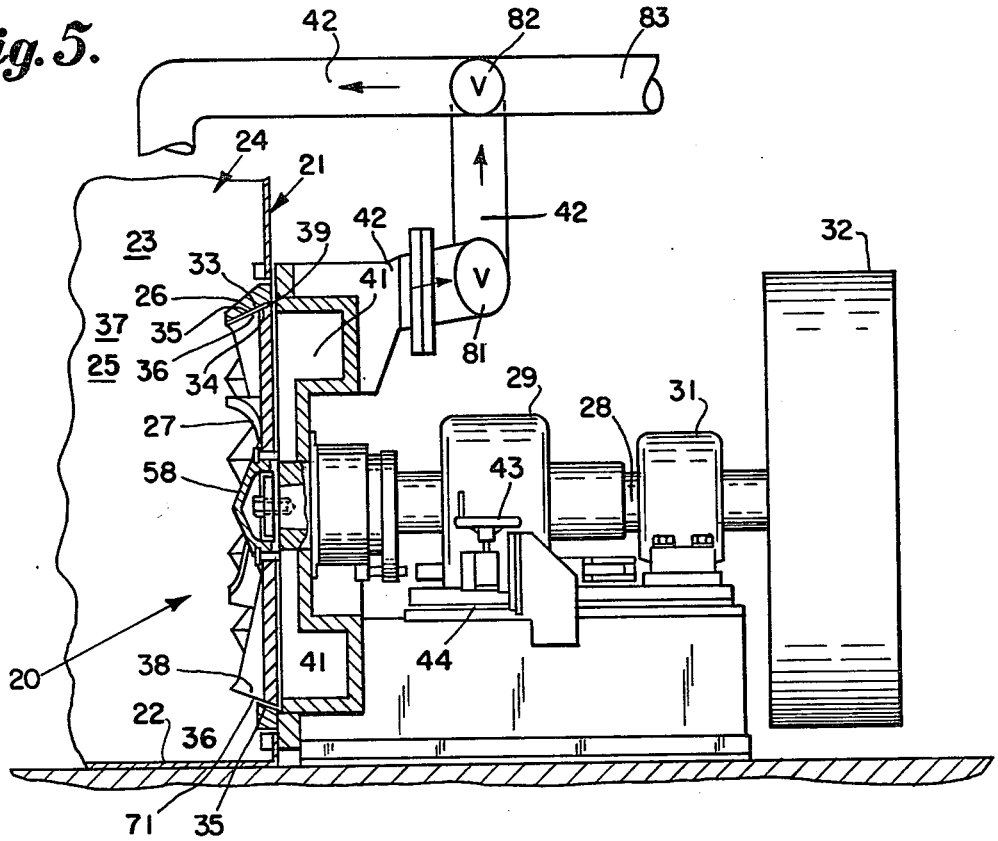
FIG. 5 is a side elevation in half section of the rotor and stator of the invention installed in the side wall of a pulper, the pulper being shown fragmentarily.

As shown in the drawings, the vortical circulation pulper 20 of the invention includes a stock container 21 having a bottom wall 22 and an upstanding side wall 23, there being an opening 24 at the top for receiving the charge 25 of the material to be pulped.

The charge 25 of material to be pulped is of stock difficult to, or impossible to, defiber in a conventional pulper with conventional clearance, thrust and horsepower for example, hemp, flax, rags, used mailbags, leather scraps, heavy latex impregnated shoe board, raw cotton and the like. When water is added to such material and pulping commenced in a conventional pulper either no defibering takes place or the pulping rotor and stator become plugged.

The zero clearance and fifty percent increase of thrust of my said U.S. Pat. No. 3,946,951 of Mar. 30, 1976 while more capable of defibering such material than conventional pulpers does so with increased wear on the parts.

In the vortical circulation pulper 20 of the invention an annular stator 26 of unique design is mounted, preferably in the side wall 23 of container 1, with a circular rotor 27, also of unique design rotatable within the stator and fast on a rotor shaft 28. Shaft 28 is cantilever supported in two spaced apart bearings 29 and 31 and driven by a sheave 32, or some other suitable power source well known in the art.

The stator 26 has a truncated conical, bladed and channeled attrition under face 33, and the rotor 27 has a truncated conical, bladed and channeled, attrition outer face 34, the faces 33 and 34 jointly forming a truncated conical attrition interface 35 with a small end 36, facing toward, and opening into, the interior 37 of the container 21 and forming the stock inlet 38. The large end 39 of the attrition interface 35 faces away from the interior of the container and discharges defibered stock into the annular chamber 41.

Defibered stock may be conducted through conduit 42 and valves 81 and 82 back into container 21 for recirculation and treatment or may be conducted through conduit 83 to further processing. Valve 81 may also be used for partial closing of discharge conduit 42 to create back pressure at the interface 35 if desired.

The shaft 28, rotor 27 and bearings 29 and 31 are movable axially as a unit by the handwheel 43 and gear and rack mechanism 44 to advance and retract the truncated conical rotor outer face 34 relative to the truncated conical under face 33 of the stator to vary clearance. Preferably the clearance at interface 33, during use, is about 5/1000 of an inch to 10/1000 of an inch so that undue wear is avoided.

The rotor 27 of the invention is provided with alternate attrition blades 45 and channels 46, the blades being angled to a radial line such as shown at 47 at an angle which is preferably about 35°. The rotor 27 is also provided with a plurality of symmetrically arranged vortical circulation vanes such as 48, each upstanding from the disc, or plate-like, circular body 49 of the rotor and each having the inner gradually inclined portion 51, preferably angularly bent at 52 for accomplishing vortical circulation.

Each vortical circulation vane 48 also includes an outer bladed edge 53, the edges 53 of all of the vanes 45 jointly outlining a truncated conical, bladed, outer face 54 for use in reducing large chunks of the difficult to defiber stock as they are moved unidirectionally, usually clockwise in a circular path designated by the hollow headed arrows, by the vortical circulation portions 51 of vanes 48.

Preferably the outer bladed edges 53 are not only sharply inclined at the preferred slope of about 60° from the plane of the body 49 of rotor 27, at the truncated conical attrition interface 35, but they are also angled, in plan, in a preferred range of between thirty to forty degrees from a radial line such as 47, the preferred angle of each bladed edge 53, from its tip 55 to its high point 56, relative to radius 47, being about thirty five degrees. The spaces between vortical circulation vanes 48 are each designated 57 and the nose cone is designated 58.

It will be understood that there is a wide variety of rotor vane and stator peak angles all of which would yield 35° intersection angle. As the rotor revolves, the leading edge of a rotor vane described a surface of revolution which is a section of a cone with the rotor disc as the base. Since the rotor vanes are arranged perpendicular to the base, but are not radially oriented, the leading edges are not coincident with the intersection of radial planes and the conical surface, rather the leading edges exhibit a leading angle of 15° in the interfacial surface with respect to the axial plane.

On the other hand, the acquisition or forward edge of each stator segment exhibits an angle substantially 50° to the axial plane in the interfacial surface. Thus the angle of intersection is 35°.

The stator 26 is shaped in an annular, symmetrical, pattern of alternate, generally triangular peaks 59 and valleys 61, the generally triangular peaks 59 being formed in a one-piece ring, or constituting individual segments, for ease of replacement. Preferably each peak 59 and valley 61 of isosceles triangle configuration in plan with the interior angle 62 at the apex and the exterior angle 63 at the bottom of each valley being obtuse.

It will be seen from FIG. 7 that the configuration of each peak, or triangular segment, 59 is unique in that it is not flat against the body 49 or rotor 27, but instead is inclined to form a portion of a truncated cone, with an outer face 64 and a truncated conical underface 65 having alternate attrition blades 66 and channels 67 running generally radially in the direction of radial line 47 on rotor 27. The outer peripheral edge 68 is normal to the plane of the body 49 of rotor 26, but curved to conform to the circular, annular configuration of the stator 26.

Each stator peak, or triangular segment, 59 includes an acquisition, or forward, edge 69 facing toward the direction of travel of chunks being circulated by the vanes 48 of the unidirectionally rotating rotor 27, that direction preferably being clockwise angularly as shown by the hollow headed arrows. Each valley 61 in advance of each acquisition edge 69 forms what I call an "acquisition space" for receiving large chunks of difficult to defiber stock so that such chunks are reduced in size by the successive scissors-like reduction impacts, rips, or tears of the outer, stock reduction edges 53 of the vanes 48 with the acquisition edges 69 of the peaks 59 of the stator 26. When the large chunks have been sufficiently reduced in size to permit the fibers therein to enter the attrition interface 35 they are further defibered therein and discharged from the large end 39 for further processing or recirculation.

The attrition interface 35 which is bladed and channeled for defibering is in rear of the stock reduction interface 71, both being truncated conical. The rearward edge 72 of each peak and the forward or acquisition edge 69 of each peak are slightly curved because formed by a flat plane intersecting a conical surface.

The angle of each acquisition edge of each peak, to a radial line such as 47 passing through the bottom of the adjacent valley 61, is in a range of about fifty to seventy degrees and preferably about sixty degrees, when viewed in plan as in FIG. 3.

Figure 6:
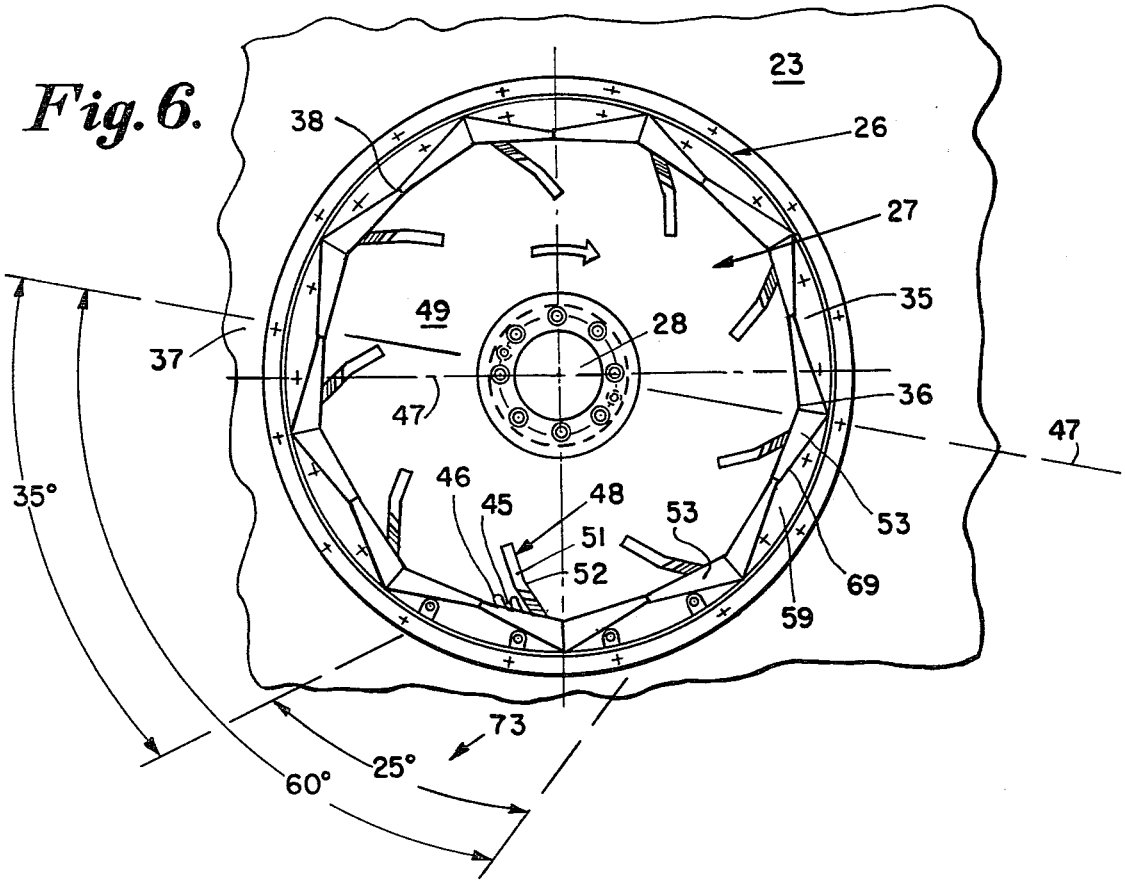
FIG. 6 is a front elevation of the rotor and stator from inside the pulper, with part of the stator broken away.

Preferably also the acquisition angle 73 which provides the preferred scissors-like reduction effect occurs when the bladed edges 53 of each rotor vane are angularly disposed to a radial line 47 at about 35°, and the acquisition edges 69 of each peak 59 are angularly disposed to the same radial line 47 at about 60° so that the acquisition angle 73 is about 25° (FIG. 6).

The acquisition angle remains about the same regardless of whether six to nine segments, or peaks are provided with six to nine vanes, or whether twenty or more peaks and valleys are provided. The number of peaks is a function of (1) rotor/stator diameter, and (2) material to be treated.

For example, with large, thick, heavy tough sheets, a 36" diameter unit would have nine segments and a similar number of vanes, with easier material, a 36" diameter unit would have eighteen to twenty segments and nine vanes, or slightly more if desired.

It should be understood that two sets of interacting blades work simultaneously, the large bladed edges of the vortical circulation vanes cooperating with the acquisition edges of the peaks of the stator to enable gross size reduction of chunks in the acquisition spaces and the smaller attrition blades and channels of stator and rotor cooperating for final defibering.

The rotor/stator combination is required to perform four different functions: (1) agitation; (2) size reduction; (3) defibering (4) circulation. Optimum energy utilization requires optimizing each of these factors in each situation; i.e., enough, but not too much. If, for example, agitation is excessive, energy is wasted; if defibering is inefficient, productivity is reduced; etc. Proper "balance" is thus implied.

With reference to the drawings it will be seen that, in contrast to the preferred design of FIGS. 2–6, the variations of FIG. 8 and FIG. 9 provides different actions, rates of recirculation, agitation, etc. The variation of FIG. 8 increases recirculation rate as well as rate of defibering and would be suitable in those situations where (1) furnish is already in small pieces (thus coarse reduction is unnecessary) and (2) agitation is not a problem. Similarly, the variation of FIG. 9 further increases recirculation rate and would be suitable in those situations where (1) furnish is fibrous (e.g., cotton) and (2) minimum agitation is sufficient.

It will be seen that the annular bladed stator 63 of FIG. 8 has nine peaks 74 of isosceles triangle outline in plan but the interior angle 62 at the apex is quite obtuse and the triangular peaks 74 are shallow to project only slightly over the rotor blades. A dwell portion 74 is provided between each adjacent pair of peaks 74 to decrease agitation, and increase recirculation rate because the furnish is already in small pieces.

In FIG. 9 the annular bladed stator 76 has eighteen identical peaks such as 77, juxtaposed with no dwell therebetween so that the stock inlet opening 78 therof is defined by a multiplicity of acquisition edges 79.

Figure 11:
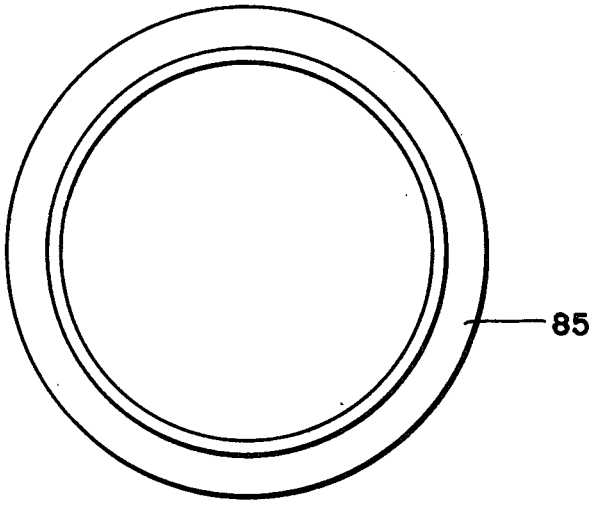
FIGS. 11, 12 and 13 are diagrammatic views similar to FIG. 6 showing other embodiments of the stator.
Figure 12:
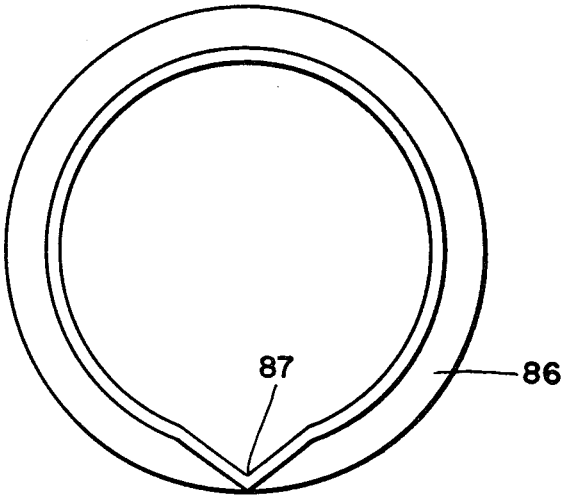
Figure 13:
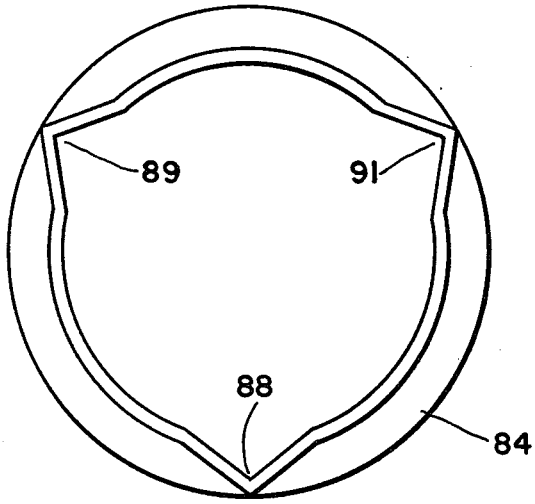

In addition to the stator designs of FIGS. 1 to 9, additional designs are shown in FIGS. 11, 12 and 13. FIG. 11 illustrates that a stator such as at 85 can be a solid, unbroken ring, if the material of the stock is already in finely divided form. With large pieces of fibrous material such a design would plug up. It will work with cotton linters without plugging up.

FIG. 12 illustrates a stator 86 with only one valley 87, or acquisition space, which would be suitable for some intermediate material and provides one escape route to avoid the possibility of plugging. The stator of FIGS. 11 and 12 would be suitable only in those instances where agitation per se is no problem.

For more difficult materials and/or where agitation would be a problem a stator 84 as shown in FIG. 13 would be advised. Stator 87 has three equally spaced valleys 88, 89 and 91 which provide increased acquisition, opportunity and increased agitation.

The nose cone 58 may be of an area at the base and of a height to nearly occupy the entire stock inlet opening or may be only large enough to guide stock coming in the axis of the rotor outwardly toward the periphery of the rotor.

Whether or not material is acquired and subsequently treated in the interface depends on the angle of intersection or "acquisition angle" 73. If too shallow, tough material merely skids along. If too steep, material cannot enter. Since treatment efficiency is a function of the product of rotor blades and stator blades, the device of this invention with its succession of individual ramps or acquisition edges 69 at optimum angle provides unusual acquisition opportunity.

In conjunction with blade and acquisition edge, or ramp, angle, velocity is critical to acquisition, too fast and there is no opportunity for stock to enter. Too slow and material escapes. Large pieces must be able to escape from the attrition zone without plugging. Recirculation, by promoting flow across the rotor stator interface produces progressively reduced particle size until defibered condition is suitable for introduction to the refiners. Preferably, rotation of the rotor is at about 430 rpm.

In operation it will be seen that no rotor/stator contact is possible in the attrition interface of the apparatus of this invention, to minimize metal wear, the clearance being fixed and therebeing no need to advance the rotor toward the stator, after furnishing to establish predetermined thrust load.

The annular, bladed, and channeled stator is so shaped that a series of acquisition edges 69 are created which, in combination with the bladed edges 53 of the rotor vanes 48, form a scissors-like action to rip, cut, shred fibrous material and the like to a completely defibered condition. By these means uncooked rags, for example, in very large pieces can be quickly and efficiently reduced to homogeneous papermaking stock.

Rapid rotor/stator wear is avoided by (A) operating at distinct clearance and (B) insuring that the entire interfacial area is properly "lubricated" with fiber to prevent metal/metal contact. This is further insured by providing multiple ramps, acquisition edges, or at critical angle to insure balanced load. In addition, the unit is operated with back pressure in the refining chamber by restricting the valves 43 or 44 in the recirculation line so as to overcome cavitation effects and thus enable complete utilization of rotor/stator edges.

In practice it has been found that this arrangement is most effective and, indeed, can substantially match the performance of the device of U.S. Pat. No. 3,946,951. It is recognized that a number of obvious variations are possible. The principle is to provide a rotor/stator combination which provides proper shear action, balanced load, complete edge utilization, and proper agitation to insure efficient reduction of fiber aggregates to individual treated fibers.

Important to the successful operation of this concept is the number and design of rotor blades, number and design of stator elements, angle of rotor/stator blade intersection, as well as back pressure in the refining chamber. These factors combine to insure that all elements of the furnish are subjected to treatment which is uniform and proper for the efficient defibering of rag stock and the like to individual elements.

In comparison with the apparatus of U.S. Pat. No. 3,946,951 the concept of this invention provides, together with proper angle of acquisition, considerably more impact opportunities at reduced severity, for similar performance with reduced wear.

It will be seen that, in view of the toughness of rag fibers and the like, considerable resistance is offered to rotor rotation, thus motor load increases significantly from so caled no load condition. With the arrangement of this invention, load typically increases about 60% above minimum in the initial stages, gradually decreasing to about 20% when treatment is complete.

I claim:

1. A vortical circulation pulper comprising:

a stock container having a bottom wall and a side wall;

a bladed and channeled stator in one of said walls and a vaned, vortical-circulation rotor, rotatable within said stator to vortically circulate stock in said container;

said stator having a truncated conical, bladed and channeled underface, a smaller open end facing into said container and a larger open end facing away from said container;

said stator being shaped in an annular, symmetrical, pattern of alternate triangular, peaks and valleys, each peak having a stock reduction, acquisition edge;

vortical circulation vanes on said rotor, each having an outer stock reduction bladed edge thereon, extending from an outer tip to a high point thereon said edges jointly outlining a truncated conical, bladed outer face;

the truncated conical, bladed and channeled underface of said stator and the truncated conical bladed outer face of said rotor forming a truncated-conical stock reduction interface;

said rotor vanes having spaces therebetween and said stator valleys constituting acquisition spaces, for receiving large chunks of said stock;

and the outer, stock reduction bladed edges of said rotor vanes cooperating with the stock reduction acquisition edges of the peaks of said stator at a predetermined acquisition angle to successively impart a scissors-like impact to said chunks received in said acquisition spaces to progressively reduce the size thereof for entering said stock reduction interface.

2. A vortical circulation pulper as specified in claim 1 wherein:

said rotor includes a plurality of alternate attrition blades and channels spaced peripherally therearound outside and beyond said outer, stock reduction, bladed edges and cooperating with the bladed and channeled underface of said stator to form a truncated conical bladed and channeled attrition interface.

3. A vortical circulation pulper as specified in claim 1 wherein:

the triangular peaks of said stator are shaped as isosceles triangles.

4. A vortical circulation pulper as specified in claim 1 wherein:

the outer bladed stock reduction, edge of each said vortical circulation vane on said rotor is angularly disposed to a radial line through the outer tip of said edge by an angle of about thirty to forty degrees.

5. A vortical circulation pulper as specified in claim 1 wherein:

the acquisition edge of each triangular peak on said stator is angularly disposed to a radial line through the bottom of the triangular valley adjacent to said peak by an angle of between fifty to seventy degrees.

6. A vortical circulation pulper as specified in claim 1:

said truncated conical stock reduction interface is at an angle of about sixty to seventy degrees from the diametrical plane of the large end of said stator.

7. A vortical circulation pulper as specified in claim 1 wherein:

the outer stock reduction, bladed edge of each said vane is angularly disposed to a radial line through the outer tip of said edge by an angle of about thirty-five degrees, the acquisition edge of each peak on said stator is angularly disposed to a radial line through the bottom of the valley adjacent to said peak by an angle of about sixty degrees and the angle between each said bladed edge and the successive acquisition edges it rotates past, when the outer tip of the bladed edge is at the outer tip of the acquisition edge is about twenty-five degrees, to constitute the acquisition angle for imparting a scissors-like reduction of large chunks of said stock.

8. A vortical circulation pulper of the type having a container, with a bottom wall and an upstanding side wall, for receiving difficult to defiber stock such as hemp, leather, cotton and the like, and having vortical circulation means mounted in one , of said walls including a rotor rotated in a circular path within a stator at predetermined clearance and thrust, said vortical circulation means characterized by:

said stator being shaped in an annular pattern of triangular segments defining alternate inwardly projecting triangular peaks, separated by triangular valleys, each successive valley forming an acquisition space for large chunks of said stock, each successive peak having a stock reduction acquisition edge angularly disposed to the path of stock moved in a circular path by the vanes of said rotor, and said stator having a truncated conical bladed and channeled underface and a small end facing the interior of said container;

said rotor having vortical circulation vanes, spaced therearound, each with an outer bladed stock reduction edge, angular disposed to the radius of said rotor, said bladed edges jointly outlining a truncated conical outer face;

and the truncated conical underface of said stator being spaced from the truncated conical outer face outlined by said rotor blade outer edges to form a truncated conical stock reduction interfacce for defibering stock reduced by a scissors-like effect imparted by the impacts of said rotor blade edges with successive acquisition edges on said segments.

9. A vortical circulation pulper as specified in claim 8 wherein:

each said bladed stock reduction edge of said rotor is at an angle of about thirty-five degrees;

and the stock reduction acquisition edge of each peak of each said segment, when the outer tip of a rotor blade edge is precisely over the outer end of said acquisition edge, is at an angle of about sixty degrees;

the acquisition angle between each said blade and each successive acquisition edge being about twenty-five degrees.

10. A vortical circulation pulper as specified in claim 8 wherein:

each said stator includes an angular zone of predetermined circumferential length between each pair of adjacent triangular peaks to constitute a series of wide valleys therearound, said wide valleys reducing agitation of said stock while increasing the rate of defibering by said interface when the stock does not require coarse reduction.

11. A vortical circulation pulper as specified in claim 8 wherein:

said stator includes at least about twenty said triangular peaks and valleys forming a multiplicity of angularly disposed stock reduction acquisition edges therearound for increasing circulation rate when said stock if fibrous and when minimum agitation is sufficient.

12. The method of reducing and defibering material difficult to defiber such as hemp, flax, rags, or leather in a vortical circulation pulper having a vaned, vortical circulation rotor, rotated at predetermined clearance within a bladed and channeled stator at predetermined horsepower and thrust, rotor vanes having stock reduction edges forming a truncated conical stock reduction interface with the bladed and channeled underface of the stator and the stator having acquisition spaces and acquisition edges, said method comprising the steps of:

charging said container with such difficult to fiber material and liquid;

rotating said vortical circulation rotor to enable the vanes thereof to vortically circulate said charge while large chunks thereof are acquired by the acquisition spaces in said stator and reduced in size by a scissors-like impact of the stock reduction edges of said rotor vanes with the acquisition edges of said stator;

and, simultaneously, defibering the portions of said stock, which have been reduced to defibering size, in said truncated conical stock reduction interface.

13. A method as specified in claim 12 plus the step:

of discharging said defibered stock from the large end of said truncated conical interface and recirculating the same back into said container; and during said recirculation, controlling the volume of recirculation thereof to control the back pressure within said interface.

14. A vortical circulation pulper of the type having a pulp container with a bladed rotor and an annular, bladed stator mounted in a side, or bottom, wall thereof, said stator and rotor having a truncated conical attrition interface, of predetermined clearance, arranged to pump stock outwardly away from the center of said container, said pulper being characterized by:

said annular, bladed stator having a plurality of triangular segments arranged symmetrically therearound to define an annular pattern of alternate peaks and valleys with a central stock inlet opening, each valley forming an acquisition space and one edge of each peak forming an acquisition edge; and said rotor having spaced blades therearound, the inner portion constituting vortical circulation vanes and the outer portion thereof forming stock reduction blades cooperable with the acquisition edges of the peaks of the segments of said stator to form a stock reduction interface and to progressively reduce chunks of said stock received in the acquisition spaces of said stator to defibering size for acceptance in said attrition interface.

15. A vortical circulation pulper comprising:

a container for material to be pulped, said container having a bladed and channeled stator and rotor in one wall thereof with a predetermined, fixed, clearance truncated-conical, attrition interface therebetween;

said stator being annular and having an inner small end with a central opening and an outer large end and said rotor having vortical circulation vanes thereon to create vortical circulation and agitation in said container by rotation in the central opening of said annular stator while pumping said material outwardly from the inner small end of said attrition interface to the outer large end of said attrition interface;

outer edges on said rotor vanes forming stock reduction blades jointly outlining a truncated control stock reduction face rotating in a circular path;

said stator comprising at least two oppositely disposed symmetrically arranged, spaced-apart triangular segments extending over the path of the stock reduction blades on said rotor and having stock reduction acquisition edges to form a stock reduction interface therewith;

said triangular segments forming an annular pattern of alternate peaks and valleys enabling chunks of said material to be accepted in said valleys and receive a scissors-like cut therealong from said stock reduction blades on said rotor as the material is circulated past individual and successive acquisition edges of the peaks of said segments and without being merely slid along said edges.

16. Apparatus for pulping difficult to defiber stock such as hemp, flax, rags, leather, or the like, said apparatus comprising:

a stock container for holding a charge of said stock in water for pulping;

circulation means for continuously circulating said charge in a path in said container;

stock reduction means, alongside said path, including a rotor and stator stock reduction interface for imparting successive scissors-like cutting impacts to large chunks of said stock to progressively reduce the size thereof to smaller sized pieces for entry into attrition means;

stock attrition means, alongside said path including a rotor and stator stock attrition interface in rear of said stock reduction interface for receiving said smaller sized pieces and defibering the same;

and means for continuously urging said chunks and pieces into said stock reduction interface and thence into said stock attrition interface.

* * * * *